US005341923A

United States Patent [19]

Arasim

[11] Patent Number: 5,341,923

[45] Date of Patent: Aug. 30, 1994

[54] PREMIUM PACKAGE

[75] Inventor: James D. Arasim, Racine, Wis.

[73] Assignee: Westerm Publishing Co., Inc., Racine, Wis.

[21] Appl. No.: 14,360

[22] Filed: Feb. 5, 1993

[51] Int. Cl.[5] ..... B65D 5/10; B65D 5/54

[52] U.S. Cl. ..... 206/214; 206/815; 206/831; 206/459.5

[58] Field of Search ..... 40/312; 206/831, 815, 206/459.5, 491, 216, 214, 224

[56] References Cited

U.S. PATENT DOCUMENTS 3,606,135 9/1971 Rosenburg, Jr. ..... 206/831 X
4,103,820 8/1978 Mathison et al. ..... 206/831 X
4,620,664 11/1986 Kaufman et al. ..... 206/831 X

*Primary Examiner*—Jacob K. Ackun, Jr.
*Attorney, Agent, or Firm*—Amster, Rothstein & Ebenstein

[57] ABSTRACT

A premium package having an easily removable premium panel secured thereto and disposed therein, includes a parallelepiped carton defining an interior void and having a pair of opposed major side panels and a pair of opposed minor side panels connecting the major side panels. At one end of the carton, a major end panel is secured to one of the major side panels and defines a tuck flap, the major end panel being movable between a closed position wherein it closes the one end of the carton and an open position wherein it enables access to the carton void. A premium panel is secured to the other of the major side panels by a line of weakness and disposed within the carton void.

6 Claims, 3 Drawing Sheets

FIG. 3
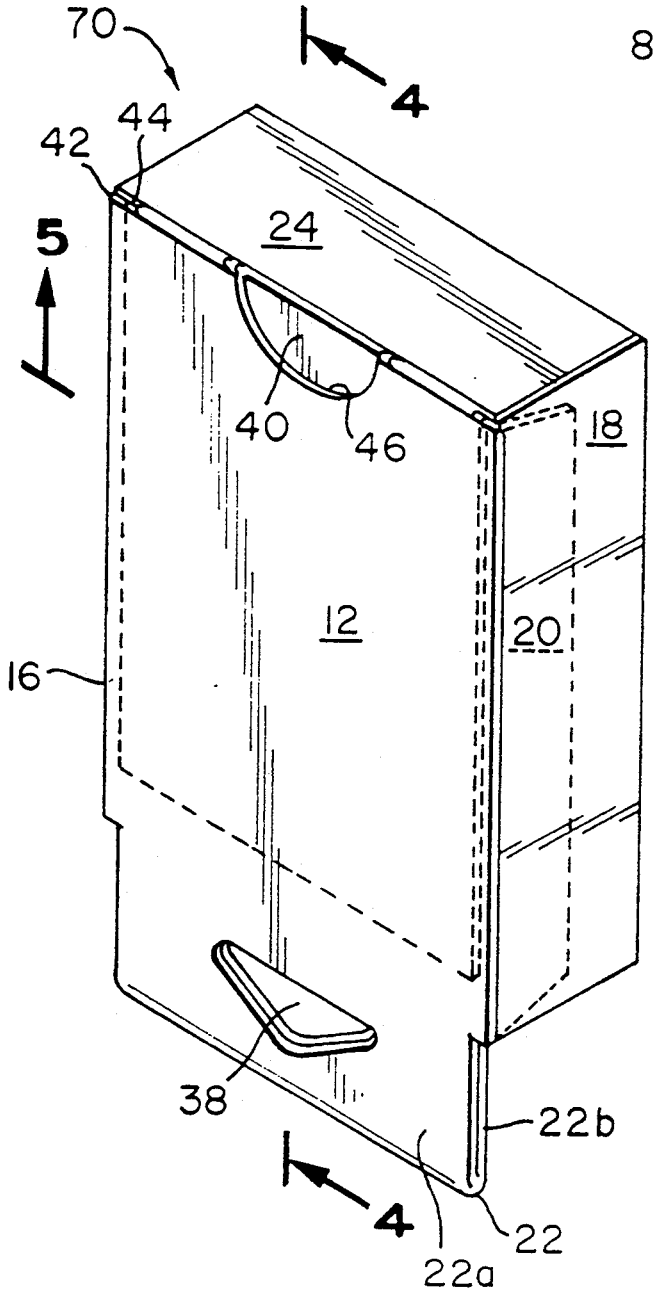
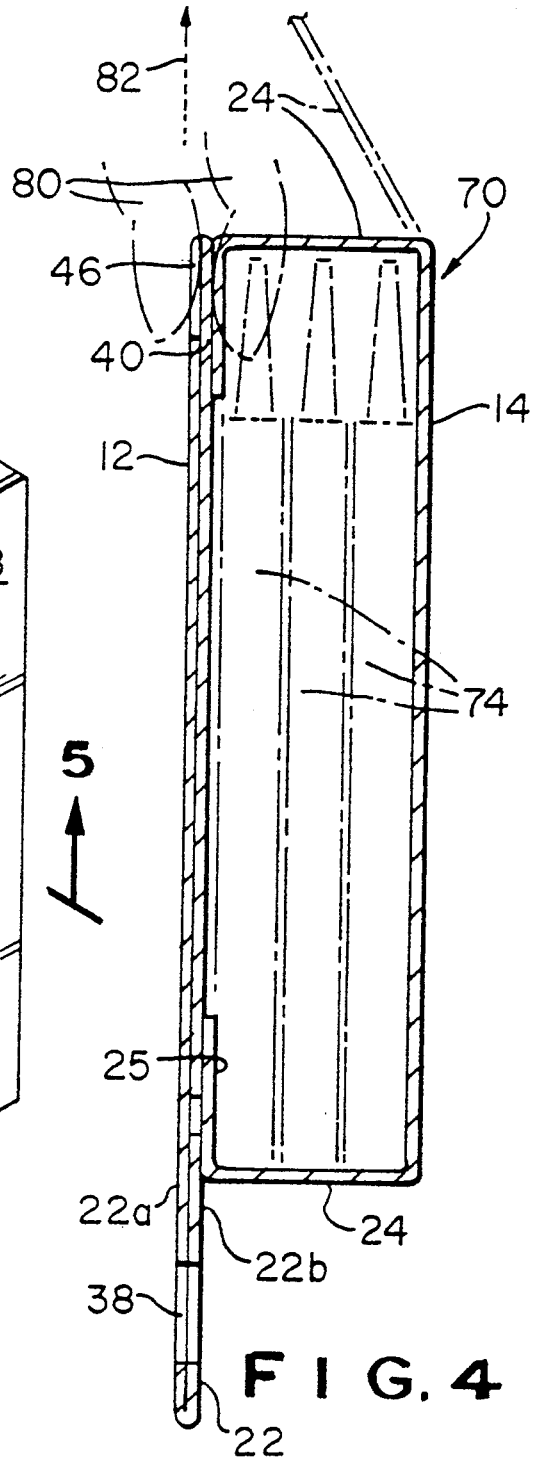
FIG. 4
FIG. 5
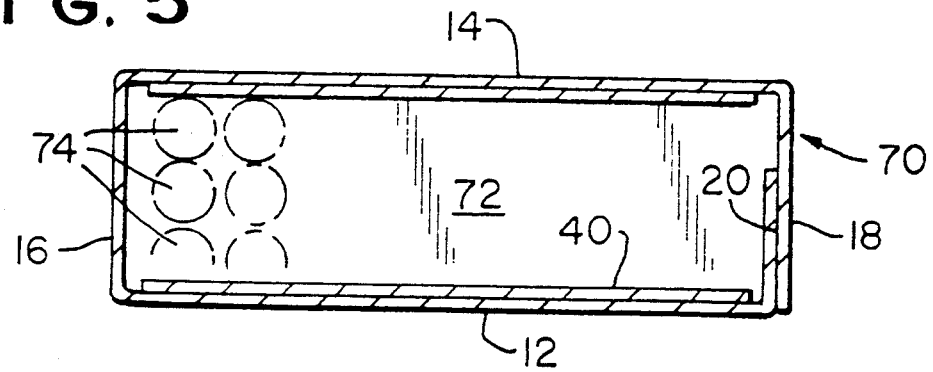

PREMIUM PACKAGE

BACKGROUND OF THE INVENTION

The present invention relates to a premium package and, more particularly, to a premium package having an easily removable premium panel secured thereto and disposed therein.

A premium package is an ordinary package which has thereon or therein a printed premium which acts as an additional inducement to purchase the package. The premium itself may have an intrinsic value and be, for example, a baseball or similar collector's card, a cooking recipe, or the like. Alternatively, the premium may have little or no intrinsic value, but be redeemable for an item of value, for example, by the purchaser removing the premium and mailing it to the manufacturer for a refund or prize. Still further, the premium may merely provide more space on which the packager may print advertising material or the like. Regardless of whether or not the premium has intrinsic value, there are common problems associated with premium packages.

If the premium is merely inserted into the package and is not secured thereto, then the premium may be forgotten or may be removed with the contents of the package and thereby lost. Accordingly, it is desirable to have a premium package where the premium panel is secured thereto rather than loosely disposed therein. On the other hand, when the premium is secured to the outer surface of the package, it is too easily removable by retail personnel and passing customers without purchase of the package, thereby defeating the purpose of the premium package and discouraging potential customers who desire the premium from purchasing the now premium-free package.

If the premium is a structural part of the actual package, for example, a coupon, emblem, or the like constituting a part of a package wall, then the premium is typically not easily removable from the package, requiring either the tearing of the package walls or the use of a knife or scissors. Furthermore, once the premium which formed a part of the package body is removed, the ability of the package to perform its intended function may be impaired as its integrity has been destroyed.

Finally, even if the premium were secured to and disposed within the package, separate and apart from the package structural walls, it would frequently be difficult to remove it from the package until all of the contents of the package were first removed.

Accordingly, it is the object of the present invention to provide a premium package having an easily removable premium panel secured thereto and disposed therein.

Another object is to provide such a package where the premium panel can easily be removed (without tools) prior to removal of the contents of the package in many instances and without destruction of the structural integrity of the package.

SUMMARY OF THE INVENTION

It has now been found that the above and related objects of the present invention are obtained in a premium package having an easily removable premium panel secured thereto and disposed therein. The package comprises a parallelepiped carton defining an interior void and having a pair of opposed major side panels and a pair of opposed minor side panels connecting the major side panels. At one end of the carton, a major end panel is secured to one of the major side panels and defines a tuck flap, the major end panel being movable between a closed position wherein it closes the one end of the carton and an open position wherein it enables access to the carton void. A premium panel is secured to the other of the major side panels by a line of weakness and disposed within the carton void.

In a preferred embodiment, the premium panel is secured at one end thereof to one end of the other major side panel by the line of weakness. The one end of the other major side panel defines a finger cutout, thereby enabling the one end of the premium panel to be grasped by fingers on both sides thereof when the one major end panel is in the open position. The one end of the carton additionally includes a pair of minor end panels secured to respective ones of the minor side panels. The major end panel in the closed position extends substantially across the thickness of the carton, covers both of the minor end panels, and has the tuck flap disposed underlying an adjacent portion of the other major side panel and the premium panel.

BRIEF DESCRIPTION OF THE DRAWING

The above brief description as well as further objects, features and advantages of the present invention will be more fully understood by reference to the following detailed description of the presently preferred, albeit illustrative, embodiments of the present invention when taken in conjunction with the accompanying drawing wherein:

FIG. 3 is an isometric view of an erected carton according to the present invention;

FIGS. 4 and 5 are sectional views thereof taken along the lines 4—4 and 5—5, respectively of FIG. 3.

DETAILED DESCRIPTION OF THE PREFERRED EMBODIMENTS

Figure 1:
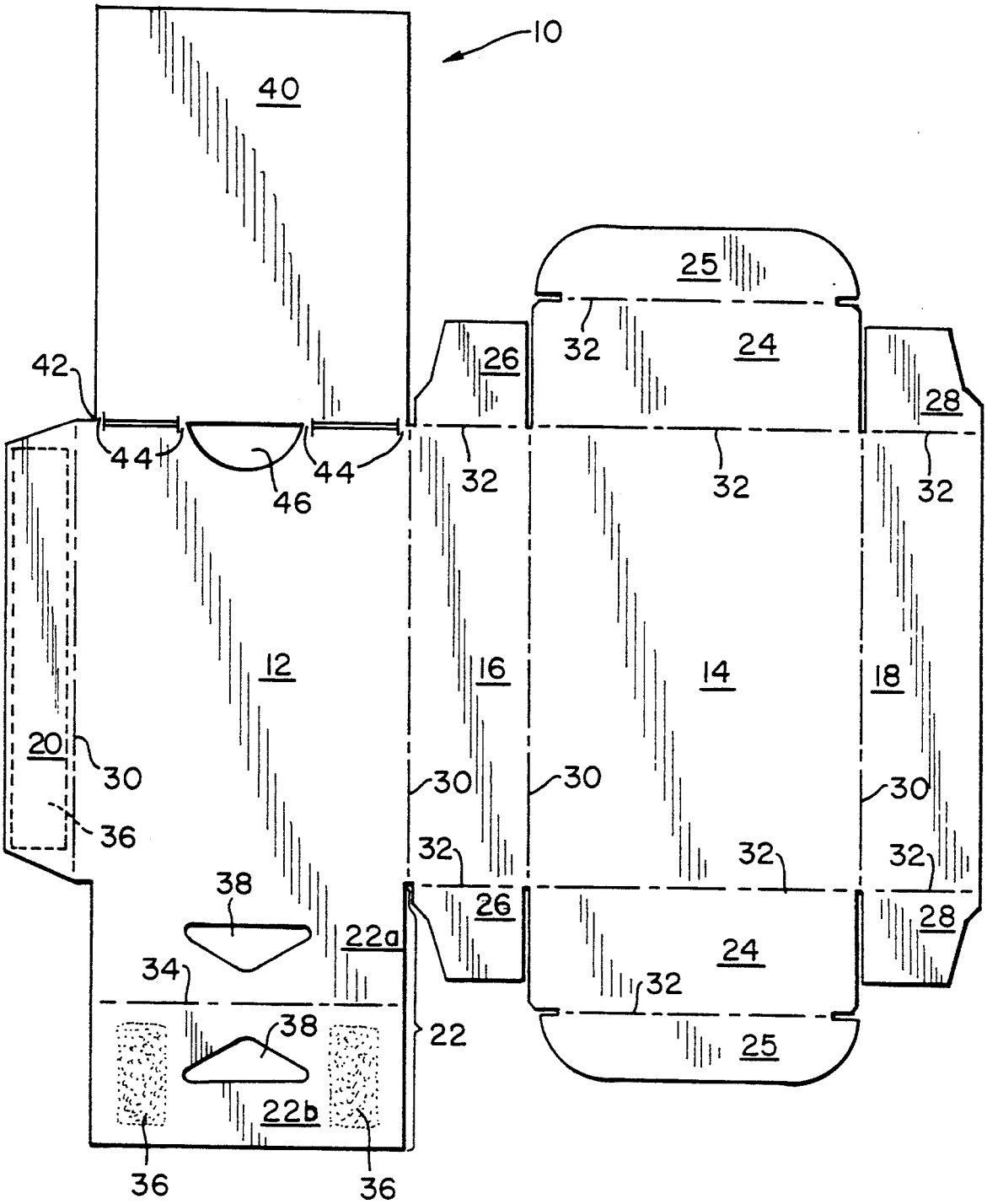
FIG. 1 is a top plan view of a blank according to the present invention.

Referring now to the drawing, and in particular to FIG. 1 thereof, there illustrated is a blank according to the present invention generally designated by the reference number 10. In its conventional aspects, the blank 10 comprises a pair of opposed major side panels—namely, a front major side panel 12 and back major side panel 14—as well as a pair of opposed minor side panels 16, 18, and a glue flap 20. The minor side panel 16 is disposed between the front and back major side panels 12 and 14 and connects the same, while the minor side panel 18 is disposed adjacent to the free side of the back major side panel 14. The glue flap 20 is disposed adjacent to the free side of the front major side panel 12. Accordingly, when a parallelepiped carton is formed from the blank 10, the minor side panel 18 is secured over the glue flap 20 (by a glue area 36) and thus connects the front and back major side panels 12 and 14.

Continuing with the conventional aspects of the blank 10, at each end of the back major side panel 14 is a major end panel 24, including at the free end thereof a conventional tuck flap 25. At each end of the minor side panel 16 is a minor end panel 26, and at each end of the minor side panel 18 is a minor end panel 28. The longitudinal foldlines 30 connect the glue flap 20, front major side panel 12, minor side panel 16, back major side panel 14 and minor side panel 18. The transverse foldlines 32 connect each minor end panel 26, 28 to the minor side panels 16, 18, respectively, and each major end panel 24 to the back major side panel 14. Transverse foldlines 32 also connect the tuck flaps 25 to the major end panels 24.

The various side panels 12, 14, 16, 18 and end panels 24, 26, 28 are generally rectangular in configuration.

A projecting suspension panel 22 is disposed at one end of the front major side panel 12 as an extension thereof, optionally with a foldline (not shown) between the front major side panel 12 and the projecting suspension panel 22. Preferably, the height of the projecting suspension panel 22 is divided generally into two half panels **22*a*, 22*b* by a transverse foldline 34 enabling the half panel 22*b* to be folded over the half panel 22*a* and secured thereto by glue areas 36. Each of the half panels 22*a*, 22*b* defines an aperture 38, the apertures 38 being aligned when with the two half panels are glued together and providing a convenient means for suspending the entire erect carton from a hook or a horizontal pipe at a point-of-sale display. Such projecting suspension panels are well known in the carton art and hence need not be described herein in any further detail. If desired, the blank may be made without a projecting suspension panel 22**.

Turning now to the novel aspects of the present invention, a premium panel 40 is secured to the end of the front major side panel 12, here illustrated as the bottom end opposite the top end having the projecting suspension panel 22. Where there is no projecting suspension panel 22, the premium panel 40 may be secured to the front major side panel at either end thereof. The premium panel 40 is illustrated as having a rectangular configuration, slightly narrower and shorter than the front major side panel 12 so that, when the carton is erected from the blank 10, the premium panel 40 will easily fit within the carton. The premium panel 40 is connected to the adjacent end of the front major side panel 12 by a tear line 42 enabling the premium panel 40 to be both folded thereover and easily removed therefrom. The tear line 42 is illustrated as a series of four narrow lands or ticks 44 laterally spaced along the adjacent sides of the premium panel 40 and the front major side panel 12. As will be apparent to those skilled in the art, a different number of lands 44 may be used and, indeed, different easily tearable tear lines may be used alternatively. The tear line 42 is frequently called a "line of weakness" in the carton art.

The front major side panel 12 defines a concave cutaway portion 46 opening onto the tear line 42 for reasons which will soon be apparent.

Figure 2:
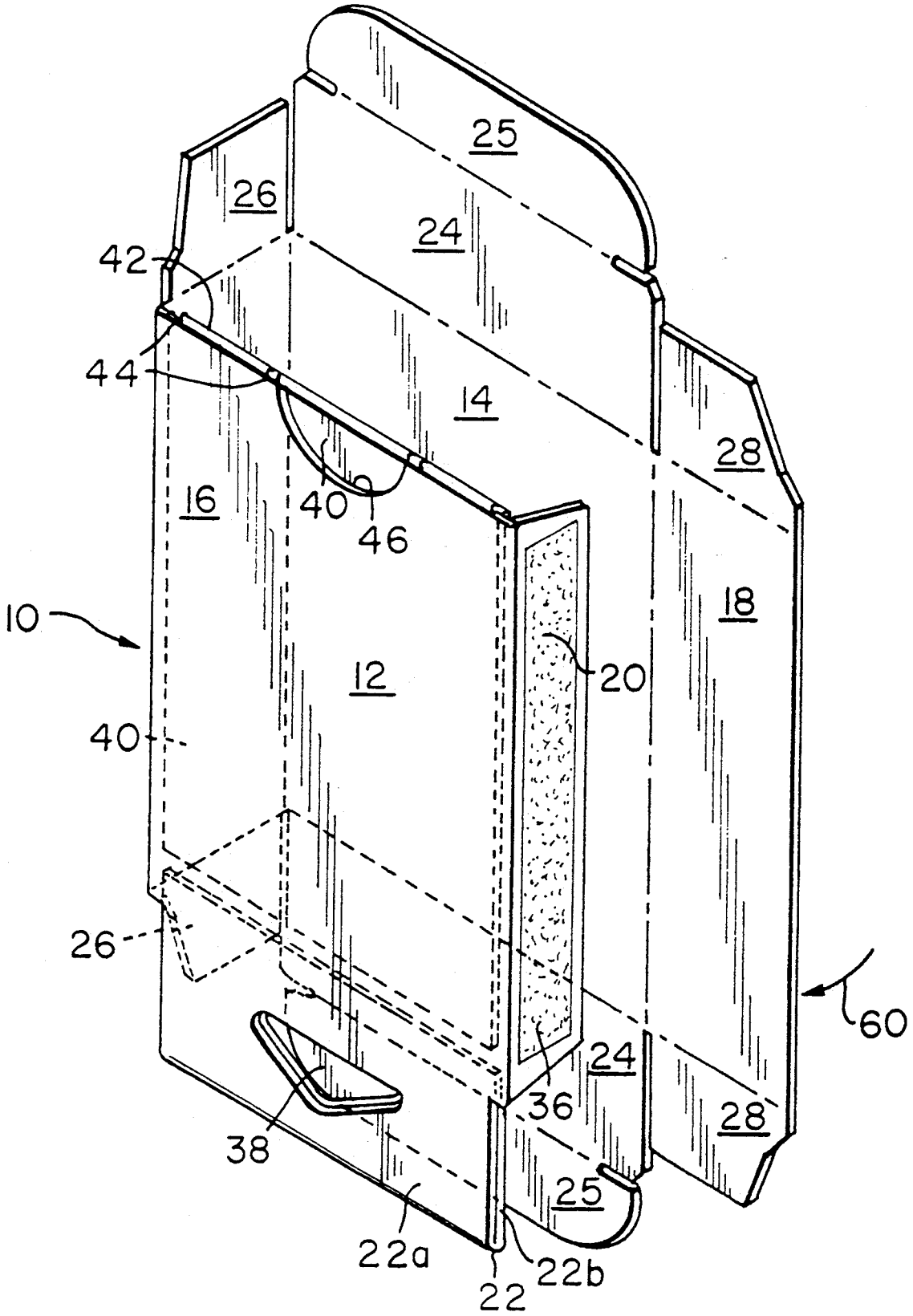
FIG. 2 is an isometric view of a partially erected carton according to the present invention, made from the blank of FIG. 1.

Referring now to FIG. 2, therein illustrated is a partially erected carton according the present invention. The glue flap 20, front major side panel 12, minor side panel 16 and back major side panel 14 have been folded relative to one another along the longitudinal foldlines 30, and the minor side panel 18 is indicated by the arrow 60 to be in the process of being folded along its longitudinal foldline 30 for contact with the glue area 36 of glue flap 20. Additionally, the projecting suspension half panels **22*b* has been folded up along transverse foldline 34 over the half panel 22*a*, and secured thereto by glue areas 36 (see FIG. 1), and the premium panel 40 has been folded down over transverse foldline 42 to overlap front major side panel 12**.

Referring now to FIGS. 3–5, therein illustrated is the premium package according to the present invention, generally designated 70. The premium package 70 has an easily removable premium panel 40 secured thereto and disposed therein. The package 70 includes a parallelepiped carton formed from the blank 10 and defining an interior void 72 (see FIG. 5). The product being sold—here illustrated as a plurality of crayons 74 (see FIGS. 4 and 5)—are disposed in carton void 72.

In completing the erection and filling of the partially erected carton in FIG. 2, the minor side panel 18 has been secured to the glue flap 20. Additionally, at each end of the carton 70, the minor end panels 26, 28 have been folded along transverse foldlines 32 so as to be transverse to the respective minor side panels 16, 18, respectively, and then the major end panels 24 have been folded along the transverse foldlines 32 over the minor end panels 26, 28 so as to be transverse to the back major side panel 14. The tuck flaps 25 have been folded along the transverse foldlines 32 so as to be transverse to the major end panels 24 and to overlap the front major side panel 12.

Use of the premium package 70 by the ultimate consumer is best illustrated in FIG. 4. The initial step, is, of course, the conventional opening of the major end panel 24 at the end of the package 70 removed from the projecting suspension panel 22. This enables a pair of the consumer's fingers 80 to grasp the premium panel 40 on both sides (in the region of the cutaway portion 46 of the front major side panel 12). A slight upward jerk on the premium panel 40 (or a slight downward jerk on the carton side walls 12–18) then snaps the lands 44 of the tear line 42 and withdraws the premium panel 40 from the remainder of the package 70. It will be appreciated that this separation of the premium panel 40 from the package 70 can be accomplished before removal of any of products 74 from the package 70 where sufficient room is provided for one of the consumer's fingers 80 to enter the carton void 72 once the major end panel 24 has been lifted in the direction of arrow 82. On the other hand, when the nature of the product 74 is such that it completely fills the carton void 72 adjacent the cutaway portion 46, some or all the product 74 may first have to be removed from the carton void 72 in order to enable the premium panel 40 to be grasped by the consumer's fingers 80 on both sides thereof.

The half panel **22*b* is preferably of a slightly greater length than the half panel 22*a* so that the free end thereof extends into the carton void 72 when the half panel 22*b* is folded over the half panel 22*a*. On the other hand, the half panel 22*b* should not extend too far into the carton void 72 as it limits the length of the premium panel 40 as both the premium panel 40 and the excess length of the half panel 22*b* are immediately adjacent to and share the length of the front major side panel 12, as illustrated in FIG. 4**.

To summarize, the present invention provides a premium package having a premium panel secured thereto and disposed therein, the premium panel being easily removable (without tools) prior to removal of the contents of the package in many instances and without destruction of the structural integrity of the package.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims and not by the foregoing specification.

I claim:

1. A premium package having an easily removable premium panel secured thereto and disposed therein, comprising a parallelepiped carton defining an interior void and having (A) a pair of opposed major side panels, (B) a pair of opposed minor side panels connecting said major side panels, and (C) at one end of said carton (i) a major end panel secured to one of said major side panels and defining a tuck flap, said major end panel being movable between a closed position wherein it closes said one end of said carton and an open position wherein it enables access to said carton void, and (ii) a removable premium panel secured to the other of said major side panels by a line of weakness and disposed within said carton void, being secured at one end thereof to one end of said other major side panel by said line of weakness, said one end of said other major side panel defining a finger cutout, thereby enabling said one end of said premium panel to be grasped by fingers on both sides thereof when said one major end panel is in said open position.

2. The package of claim 1 additionally including at said one end of said carton a pair of minor end panels secured to respective ones of said minor side panels.

3. The package of claim 2 wherein said major end panel in said closed position extends substantially across the thickness of said carton, covers both of said minor end panels, and has said tuck flap disposed underlying an adjacent portion of said other major side panel and said premium panel.

4. The package of claim 1 wherein said premium panel is not folded and has a dimension greater than said major end panel.

5. The package of claim 1 wherein said premium panel is secured parallel to said other major side panel.

6. A premium package having an easily removable premium panel secured thereto and disposed therein, comprising a parallelepiped carton defining an interior void and having (A) a pair of opposed major side panels, (B) a pair of opposed minor side panels connecting said major side panels, and (C) at one end of said carton (i) a major end panel secured to one of said major side panels and defining a tuck flap, said major end panel being movable between a closed position wherein it closes said one end of said carton and an open position wherein it enables access to said carton void, (ii) a premium panel secured at one end thereof to one end of the other of said major side panels by a line of weakness and disposed within said carton void, and (iii) said one end of said other major side panel defining a finger cutout, thereby enabling said one end of said premium panel to be grasped by fingers on both sides thereof when said one major end panel is in said open position;

said major end panel in said closed position extending substantially across the thickness of said carton and having said tuck flap disposed underlying an adjacent portion of said other major side panel and said premium panel.

* * * * *